US009375720B2

(12) United States Patent
Moosmann et al.

(10) Patent No.: US 9,375,720 B2
(45) Date of Patent: Jun. 28, 2016

(54) BEATER BAR FOR AN IMPACT CRUSHER, IN PARTICULAR A ROTARY IMPACT CRUSHER

(76) Inventors: Bernhard Moosmann, Schramberg-Waldmössingen (DE); Jochen Meier, Hülben (DE); Thomas Kuehnle, Filderstadt (DE)

( * ) Notice: Subject to any disclaimer, the term of this patent is extended or adjusted under 35 U.S.C. 154(b) by 546 days.

(21) Appl. No.: 13/679,769

(22) PCT Filed: Mar. 23, 2011

(86) PCT No.: PCT/EP2011/054478

§ 371 (c)(1),
(2), (4) Date: Nov. 16, 2012

(87) PCT Pub. No.: WO2011/128195

PCT Pub. Date: Oct. 20, 2011

(65) Prior Publication Data

US 2013/0099037 A1 Apr. 25, 2013

(30) Foreign Application Priority Data

Apr. 16, 2010 (DE) ..... 10 2010 016 498

(51) Int. Cl.
*B02C 13/28* (2006.01)

(52) U.S. Cl.
CPC ..... *B02C 13/2804* (2013.01); *B02C 13/28* (2013.01)

(58) Field of Classification Search
CPC ..... B02C 4/30; B02C 4/305; B02C 13/28; B02C 13/2804; B02C 2210/01; B02C 2210/02
USPC ..... 241/197, 294, 300
See application file for complete search history.

(56) References Cited

U.S. PATENT DOCUMENTS

| | | | | |
|---|---|---|---|---|
| 883,619 | A * | 3/1908 | Canda | 241/294 |
| 1,947,440 | A * | 2/1934 | Milne | 241/294 |
| 3,462,090 | A * | 8/1969 | Andrews et al. | 241/299 |
| 3,642,214 | A * | 2/1972 | Blackwell, Jr. | 241/191 |
| 4,319,719 | A * | 3/1982 | Larsen | 241/183 |
| 4,717,083 | A * | 1/1988 | Quast et al. | 241/197 |
| 4,871,119 | A | 10/1989 | Murata et al. | |
| 5,114,082 | A * | 5/1992 | Brundiek | 241/121 |
| 6,086,003 | A * | 7/2000 | Gunter et al. | 241/235 |
| 6,089,480 | A * | 7/2000 | Rawlings | 241/73 |
| 7,416,145 | B2 * | 8/2008 | Hall et al. | 241/197 |
| 7,494,080 | B2 * | 2/2009 | Knotts | 241/197 |
| 7,510,135 | B2 * | 3/2009 | Burchardt et al. | 241/294 |
| 7,712,692 | B2 * | 5/2010 | Hall et al. | 241/197 |

(Continued)

FOREIGN PATENT DOCUMENTS

| | | |
|---|---|---|
| DE | 16 58 400 U1 | 6/1953 |
| DE | 2 343 691 A1 | 3/1974 |

(Continued)

*Primary Examiner* — Faye Francis
(74) *Attorney, Agent, or Firm* — Pauley Erickson & Kottis

(57) ABSTRACT

A beater bar for a rock impact crusher, in particular a rotary impact crusher, including a carrier which, in the region of a cutting edge, has a plurality of cutting elements made of a hard material arranged next to one another. For the purpose of simple maintenance and for improved cost-effectiveness of the beater bar, according to this invention two or more cutting elements are fastened on a cutting-element holder, and two or more cutting-element holders can be interchangeably fastened to the carrier.

26 Claims, 4 Drawing Sheets

(56) References Cited

U.S. PATENT DOCUMENTS

| | | | | |
|---|---|---|---|---|
| 8,622,330 | B2 * | 1/2014 | Mepham et al. | 241/182 |
| 2008/0203202 | A1 | 8/2008 | Clark et al. | |

FOREIGN PATENT DOCUMENTS

| | | | |
|---|---|---|---|
| DE | 3807 176 | A1 | 10/1988 |
| DE | 195 27 913 | A1 | 2/1996 |
| DE | 295 21 050 | U1 | 10/1996 |
| DE | 20 2006 019 687 | U1 | 4/2007 |
| EP | 0 581 758 | A1 | 2/1994 |
| GB | 1443531 | | 7/1976 |
| GB | 2 202 463 | A | 9/1988 |
| WO | WO 2008/080710 | A1 | 7/2008 |

* cited by examiner

BEATER BAR FOR AN IMPACT CRUSHER, IN PARTICULAR A ROTARY IMPACT CRUSHER

BACKGROUND OF THE INVENTION

1. Field of the Invention

This invention relates to a blow bar for an impact crusher, in particular a rotary impact crusher, having a carrier, which, in a region of a cutting edge, has a plurality of cutting elements made of hard material arranged next to one another.

2. Discussion of Related Art

European Patent Reference EP 0 581 758 B1 discloses a rotary impact crusher equipped with several blow bars. The blow bar includes a carrier that can be clamped by a wedge clamp to an anchoring attachment to permit the blow bar to be interchangeably affixed to the rotor of a rotary impact crusher. The carrier has a seating surface facing in the tool-advancing direction onto which a plurality of cutting elements are placed and can be lined up in a longitudinal direction of the blow bar. The cutting elements are first placed loosely onto the carrier. As soon as the wedge connection is clamped, then the cutting elements are affixed to the carrier in captive fashion. If one or more of the cutting elements becomes worn, then the clamped connection must be released. Then the respective cutting elements can be replaced with non-worn cutting elements. This known type of fixing the cutting elements to the carrier has turned out to be unsuitable in actual practice. In particular, when the blow bar to be serviced is in a lower position of the rotor, after the clamped connection is released, the cutting elements can fall in an uncontrolled fashion and must then be laboriously collected and placed onto the carrier. Furthermore, the contact surfaces of the carrier and cutting elements must be very precisely matched to one another in order to enable a gap-free connection. Because the cutting elements, which are embodied as sintered components, can only be produced within a certain tolerance range, the gap-free association with the carrier can never be completely guaranteed, leading to frequent breakage of cutting elements.

German Patent Reference DE 23 43 691 discloses another blow bar having three hard metal plates fastened to a carrier. Here, a screw connection is used to clamp the hard metal plates into recesses in the carrier. German Patent Reference DE 295 21 050 U1 discloses a similar arrangement in which the carrier of the blow bar has a dovetail-shaped groove into which a dovetail-shaped insertion lug of the bar-shaped cutting element is slid. In blow bars of this type, there is frequently the danger that powerful impact stress results in bar breakage. Then, the entire cutting element must be expensively replaced.

German Patent Reference DE 16 58 400 U1 discloses another blow bar in which a hard metal block extending the entire width of the blow bar is soldered to the carrier.

SUMMARY OF THE INVENTION

One object of this invention is to provide a rugged blow bar that is easy to service.

This object of this invention is attained with two or more cutting elements fastened on a cutting element holder so that it is possible to interchangeably fasten two or more cutting element holders to the carrier.

Two or more cutting element holders are thus built into the unit to produce the cutting edge and in turn carry two or more cutting elements. The cutting element holders thus form or constitute individually manipulable subassemblies that can be securely installed on the carrier in a short amount of time in order to produce the cutting edge. If abrasion has caused the cutting element to reach its wear limit, then the cutting element holder that carries this cutting element can be removed and replaced independently of the other cutting element holders. This permits the maintenance to be carried out in a time-optimized, economical, and reliable fashion.

In one embodiment of this invention, the cutting elements are integrally joined to the cutting element holder, preferably soldered. This achieves a gap-free, non-breakage-prone association or connection between the cutting elements and the cutting element holder.

In one embodiment of this invention, the carrier has a recess with a supporting surface and a bearing surface at an angle thereto, with the supporting surface facing in the tool-advancing direction, the cutting element holder is supported on this supporting surface by a contact surface facing away from the tool-advancing direction, and a bottom adjoining the contact surface of the cutting element holder rests against the supporting surface over a large area. This invention recognizes that during the tool engagement, there is a varying course of the force. The supporting surface and the bearing surface reliably intercept these machining forces and divert them into the carrier, so that the cutting element holder is always securely fixed.

In another embodiment of this invention, the cutting element holder is connected to the carrier by at least one fastening lug, which is inserted into a fastening socket and the fastening lug has a threaded opening that is flush with a screw opening that feeds into the fastening socket. The fastening lug can be disposed on the cutting element holder and the fastening socket can be disposed on the carrier, or vice versa. When transverse forces occur, the fastening lug is supported in the fastening socket and carries the forces past or beyond this supporting region. Thus the fastening screws, which connect the cutting element holder to the carrier, are kept fee of transverse forces. With this simple provision, a markedly improved diversion of force is possible.

If it is possible to position the cutting element holders in a preassembly position on the carrier in which they are adjustable relative to one another, then the cutting element holders in the preassembly position can be pushed against one another without play and then finally fixed in position. As a result, the cutting elements can be pushed against one another without play, and thus in the connection points during tool use, no harmful transverse forces can become operative.

In this embodiment, for example, a blow bar of this invention provides the fastening lug inserted with play into the fastening socket, and when the connection, preferably a threaded connection, is released, the cutting element holder is adjustable to a limited degree in the longitudinal direction of the cutting edges.

If the carrier has screw openings that are let into the carrier from the rear facing away from the tool-advancing direction and fastening screws are inserted through the screw openings and screwed into the cutting element holder, then the screw head is positioned on the back side of the carrier in a wear-protected fashion. Then, if needed, the fastening screw can always be reliably loosened. If the fastening screw is screwed into a threaded opening in the form of a blind hole in the cutting element holder, then the threaded opening is accommodated in a protected fashion as well, and no crushed material that would block the threaded connection can penetrate into the threaded region.

To minimize carrier wear, one embodiment of this invention provides that at the radially outer end facing away from the tool-advancing direction, the cutting element holder has a chip-diverting surface that transitions in a flush manner into a diverting surface of the carrier. Thus, the carrier is covered by the cutting element holder and is protected against the rock material to be crushed.

A blow bar according to this invention can be arranged to that transversely to the tool-advancing direction, the cutting element holder is adjoined by a front surface of a base part of the carrier and that an impact rocker is attached to the base part, facing away from the cutting insert. By equipping the blow bar with cutting elements according to this invention, wear in the vicinity of the cutting edge is initially optimized. As a result, reduced wear to the impact rocker then surprisingly ensues.

One object of this invention is also attained with a cutting insert for a blow bar, having a cutting element holder to which a plurality of cutting elements made of hard material are attached, in which the cutting elements are arranged next to one another transversely to the tool-advancing direction and form a cutting edge. In this embodiment, the cutting element holder has a rear contact surface facing away from the tool-advancing direction, from which a fastening lug integrally formed onto the cutting element holder protrudes. This fastening lug is preferably provided with a threaded opening. This cutting insert can be built easily and quickly onto a carrier of a blow bar. Thus, the cutting insert need merely be inserted by its integrally formed-on fastening lugs in fastening sockets, provided for them, in the carrier. The cutting insert can then be screwed to the carrier via the threaded openings in the fastening lug. The fastening lugs keep the fastening screws free from transverse forces exerted during tool use. Thus stable coupling of the cutting insert to the carrier is realized. In the event of damage, the cutting insert can easily be replaced by undoing the threaded connections and then removing the cutting element holder from the carrier. It can then be replaced with a new, unworn cutting insert.

The fastening lug can be manufactured simply and dimensionally precisely if it has a square or rectangular geometry in cross-section.

Preferably, the central longitudinal axis of the threaded opening extends vertically relative to the contact surface so that the forces induced by the fastening screw are transferred directly into the contact surface. It has been demonstrated that a very stable coupling of the cutting insert, without the risk of breakage, is possible as a result.

One embodiment of a cutting insert includes the cutting element holder having a bottom that adjoins the contact surface at right angles to it. By the bottom and the contact surface, the cutting insert can be optimally supported on corresponding bearing surfaces.

If the cutting element holder has a seating surface, which is inclined away from the tool-advancing direction and to which the cutting elements are coupled over a large area by a supporting section, then a geometry of the cutting element holder that is easy to manufacture is possible, and the inclined seating surface optimally takes into account the varying course of the force during tool engagement and thus serves to brace the cutting element reliably. The cutting element can in particular be soldered to the seating surface, to ensure a play-free connection.

Another wear protection of the cutting insert can be produced so that the cutting element holder has a receiving region in which a plurality of wear plates made of hard material are lined up in the longitudinal direction of the cutting insert and the wear plates, adjoin the cutting elements directly. Because a plurality of wear plates are used, a segmented structure is produced, which results in a significantly reduced risk of breakage for the wear plates. The lining up of the wear plates, which should in particular be free of gaps, prevents the wear plates from being subjected to undue transverse forces, which could break them. Because the wear plates directly adjoin the cutting elements, this prevents the wear plates from eroding the region under the cutting elements.

In this case, it can be advantageous for two wear plates per cutting element to be installed and for the cutting elements to have double the width of the wear plates in the longitudinal direction of the cutting insert.

A cutting insert according to this invention can have the cutting elements triangular in cross-section and can have an impact surface facing in the tool-advancing direction and at an angle thereto have a free surface facing away from the tool-advancing direction. The free surface and the advancing normal oriented in the tool-advancing direction enclose a free angle so that the free surface slopes downward from the cutting edge in the direction opposite the tool-advancing direction. This design produces a self-sharpening geometry for the cutting element. As a result, when an abrasion-induced wear of the cutting elements occurs, a sharp-edged cutting is retained.

BRIEF DESCRIPTION OF THE DRAWINGS

This invention is explained in greater detail in view of an exemplary embodiment shown in the drawings, wherein.

DETAILED DESCRIPTION OF THE INVENTION

Figure 1:
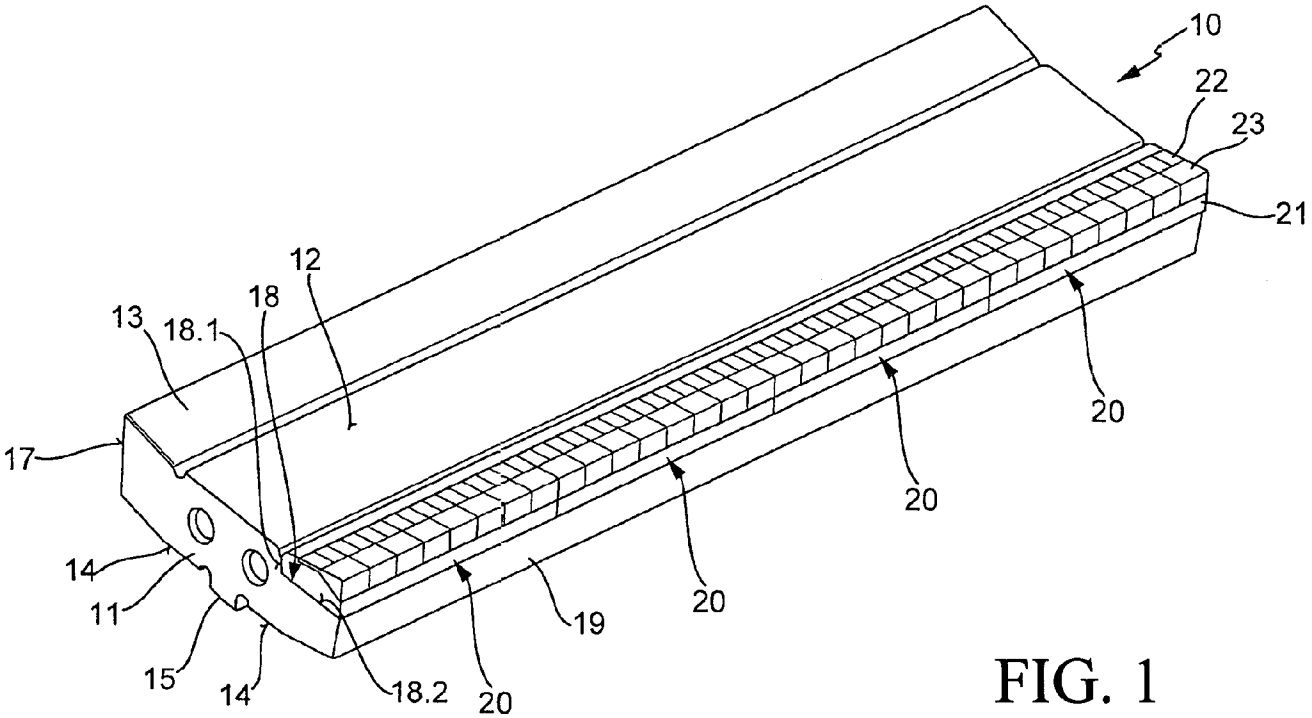
FIG. 1 shows a blow bar in perspective in a side view.

FIG. 1 shows a blow bar, which has a carrier 10. The carrier 10 has a base part 11, which forms a front face 12 pointing in the tool-advancing direction (V). The base part 11 is adjoined laterally by a lower part 13, and the impact rocker 13 has an upper face oriented toward the front face 12. Facing away from the impact rocker 13, the base part 11 has a lug, into which a recess 18 in the form of a milled-out area is machined. The recess 18 forms a supporting surface 18.2 and a bearing surface 18.1 at an angle to it. The supporting surface 18.2 pointing in the tool-advancing direction (V) transitions to a diverting surface 19. On the back, the carrier 10 has protrusions 15, which are used for fixing a rotor of a rotary impact crusher. On both sides of the protrusions 15, supporting surfaces 14 are provided. In the vicinity of or near the impact rocker 13, the carrier 10 forms a seating surface 17. This face is disposed at an angle to the supporting surface 14 on the back. By means of or with the supporting surface 14 and the seating surface 17, the carrier 10 can be reliably supported on the rotor. As shown in FIG. 1, four cutting inserts 20 are built into the recess 18, which are disposed side by side in the longitudinal direction of the carrier 10.

Figure 2:
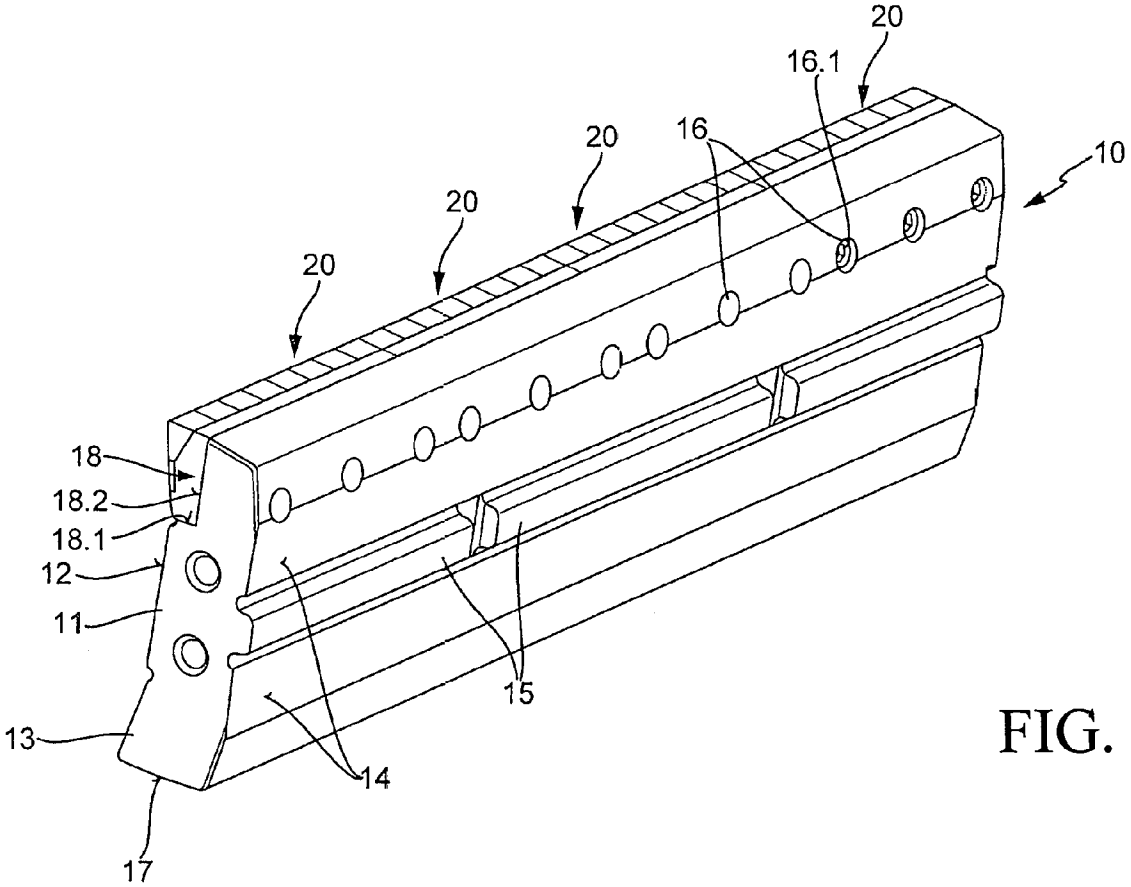
FIG. 2 shows the blow bar of FIG. 1 in perspective in a rear view.

FIG. 2 shows the arrangement of FIG. 1 in perspective in a rear view. As shown in this view, three protrusions 15 which are separated from one another by grooves are integrally formed onto the base part 11 on the back. Beginning at the back side of the carrier 10, fastening sockets 16 in the form of bores are made in the carrier 10. These bores open in the bearing surface 18.2 of the recess 18. Fastening screws 16.1 can be passed through the fastening socket 16 and screwed into the cutting inserts 20, as will be explained hereinafter.

Figure 3:
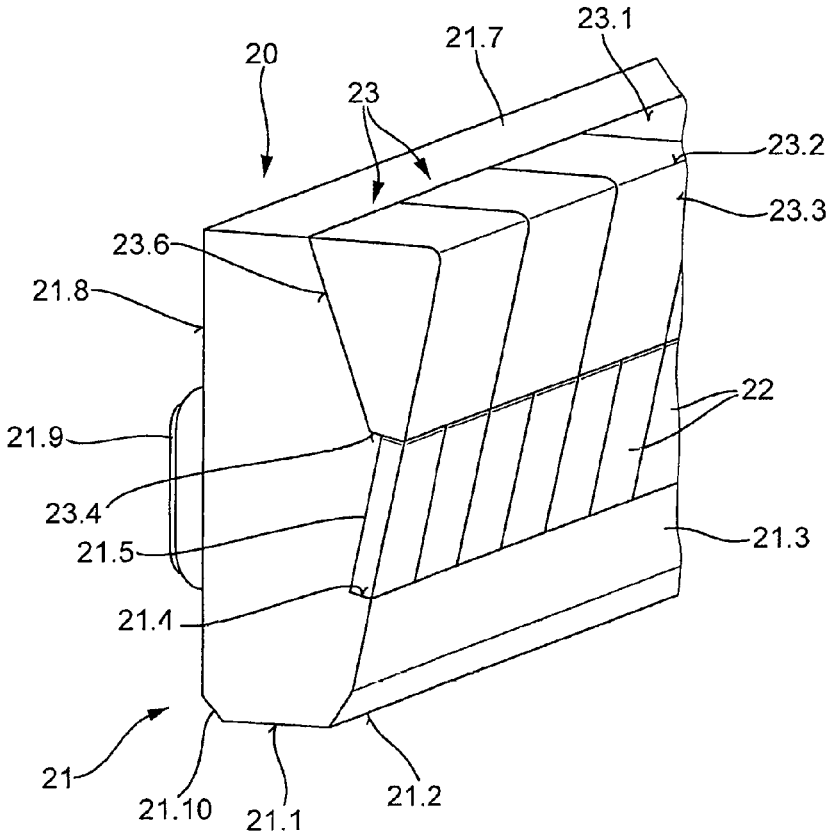
FIG. 3 shows a cutter insert, which can be built into the blow bar of FIGS. 1 and 2, in a fragmentary perspective view.

As shown in FIG. 3, the cutting insert 20 includes a cutting element holder 21, on which cutting elements 23 and wear plates 22 are fastened. The cutting element holder 21 has a vertical contact surface 21.8, which is adjoined by a bottom 21.1 via a chamfer 21.10. In the assembled state, the bottom 21.1 is supported on the bearing surface 18.1 of the carrier 10, and the contact surface 21.8 is supported on the supporting surface 18.2. The chamfer 21.10 guarantees reliable contact with the supporting surface 18.2 and bearing surfaces 18.1. At the front, the bottom 21.1 transitions to a diagonally extending transitional portion 21.2. The transitional portion 21.2 is adjoined by a front face 21.3, which is positioned at an angle greater than 90° relative to the bottom 21.1 extending in the tool-advancing direction. This positioning angle is preferably selected within the range between 95° and 120°, to make possible a geometry that is favorable from the standpoint of wear. Above the front face 21.3 is an adjoining milled-out area 21.5 into which the wear plates 22 are inserted. The milled-out area 21.5 is dimensioned so that the surfaces of the wear plates 22 transition flush to the front face 21.3. The milled-out area forms a contact surface 21.4 with which the wear plates 22 can be aligned. As a result, simpler manufacture is possible. The wear plates 22 are firmly soldered in the milled-out area 21.5 on the back by hard solder.

The milled-out area 21.5 is adjoined by a seating surface 21.6. This seating surface 21.6 is inclined counter to the tool-advancing direction V and toward the back side of the cutting insert 20. The cutting element 23 can be firmly soldered to the seating surface 21.6 with a flat supporting portion 23.5. The cutting element 23 is dimensioned so that with a protrusion 23.4 on its underside, it covers the face end, oriented toward it, of the wear plate 22, and an impact surface 23.3 on the front transitions flush to the front side of the wear plates 22. This gapless, flush transition prevents crushed material from penetrating and exerting impermissible shear forces on the cutting elements 23 and the wear plates 22. These shear forces would expose the hard-metal wear plates 22 and cutting elements 23 to the risk of breakage. The impact surface 23.3 extends in inclined fashion and points in the tool-advancing direction V. With a free surface 23.1, the impact surface 23.3 forms an angle of less than 90°, and in the transition region between the free surface 23.1 and the impact surface 23.3, a cutting edge 23.2 is formed. The free surface 23.1 in turn transitions flush to a diverting surface 21.7 of the cutting element holder 21.

Figure 4:
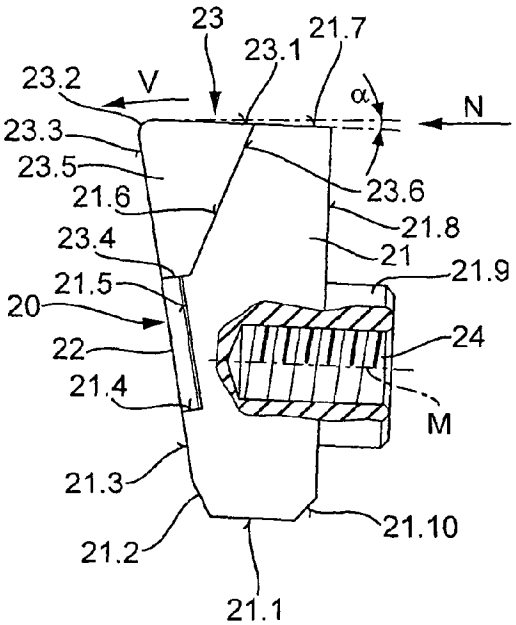
FIG. 4 shows the cutting insert of FIG. 3 in a side view.

FIG. 4 shows that the cutting elements 23 are provided laterally with side surfaces 23.5 that extend in the tool-advancing direction V. Via these side surfaces 23.5, the cutting elements 23 can be lined up with one another in gapless, flush fashion. Per cutting element 23, two wear plates 22 each are built in, and the two wear plates 22 have a total width that is equivalent to the width of the cutting element 23.

Figure 5:
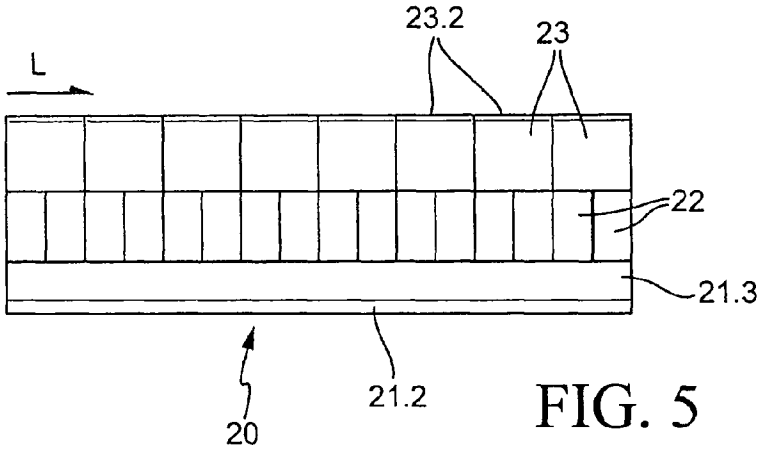
FIG. 5 shows the cutting insert of FIG. 4 in a front view.
Figure 6:
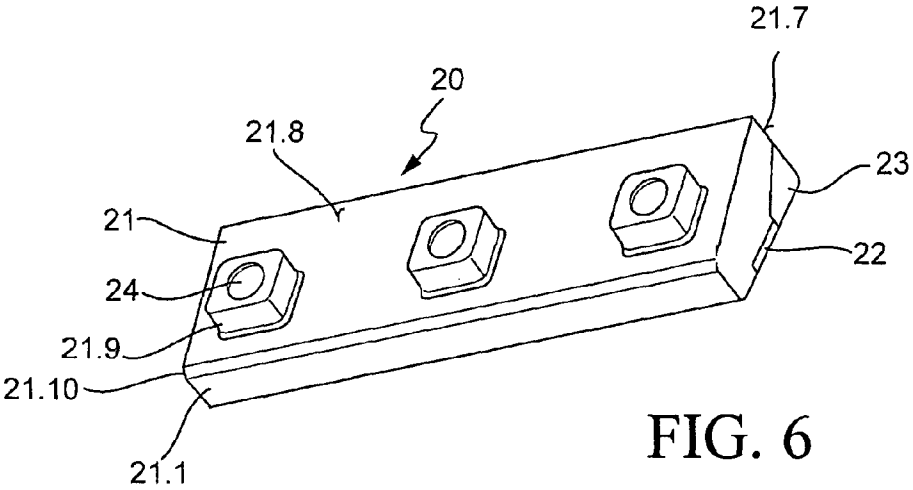
FIG. 6 shows the cutting insert of FIGS. 3-5 in perspective in a rear view.

As shown in FIG. 5, preferably eight cutting elements 23 are fastened to one cutting element holder 21. Accordingly, sixteen wear plates 22 are used.

It shown in FIGS. 4 and 5 that on the back side of the cutting element holder 21, three fastening lugs 21.9 protrude past or beyond the contact surface 21.8. The fastening lugs are embodied with a square cross section and are penetrated by a blind-bore-like threaded opening 24, as shown particularly in FIG. 4. The threaded opening 24 terminates behind the wear plates 22 in the cutting element holder 21. The threaded opening 24 has a center longitudinal axis M which can be disposed or positioned in alignment with the fastening socket 16 of the carrier 10. With the cutting insert 20, the carrier 10 here has three recesses, which have a cross-sectional shape corresponding to the fastening lugs 21.9. The internal dimensions of these recesses are selected to be slightly larger than the external dimensions of the fastening lug 21.9. In this way, play is created, which enables a limited adjustment of the cutting insert 20 relative to the carrier 10, when the cutting insert 20 is in an unfixed preassembly position.

FIG. 4 also shows that the diverting surface 21.7 transitions flush to the free surface 23.1. Beginning at the cutting edge 23.2, the free surface 23.1 is inclined counter to the tool-advancing direction and at an angle $\alpha$ to the advancement normal extending in the tool-advancing direction V. In this way, a self-sharpening geometry is ensured, which maintains the functionality of the sharp-edged cutting edge 23.2.

For assembling the cutting inserts 20, they are inserted by their fastening lugs 21.9 into the corresponding recesses 18 in the carrier 10. Next, from the back side of the carrier 10, the fastening screws 16.1 are passed through the fastening sockets 16 and screwed into the threaded opening 24 in the cutting element holder 21. At this time the fastening screws 16.1 have not yet been tightened, so that the cutting inserts 20 are in a preassembly position. Next, the cutting inserts 20 are pushed against one another in the longitudinal direction L, as shown in FIG. 5, of the cutting inserts 20 on the supporting surface 18.2 and the bearing surface 18.1, so that they contact one another in gapless fashion. The displacement motion is enabled by the play between the fastening lugs 21.9 and the recesses in the carrier 10. Once the cutting inserts 20 have been pushed against one another, the fastening screws 16 can be tightened with the prescribed torque, and the cutting inserts 20 are then securely fastened to the carrier 10.

During operational use, wear to the cutting edge 23.2 of the cutting elements 23 occurs because of the contact with the rock materials that are to be crushed. In the process, the cutting elements 23 become worn in the vertical direction, such as transversely to the tool-advancing direction V. As FIG. 4 shows, the cross-sectional shape of the cutting elements 23 is selected to be triangular, so that a high proportion of hard material is positioned in the vicinity of or near the cutting edge 23.2. In this way, a long service life is possible in a manner optimized with regard to material.

Once the cutting elements 23 have reached their wear limit, the cutting insert 20 can be replaced without problems. All that has to be done is for the fastening screws 16 to be loosened, and the cutting insert 20 to be replaced by an unworn cutting insert 20. Under impermissible usage conditions, it can sometimes happen that a cutting element 23 of a cutting insert 20 will break prematurely. In that case, the cutting insert 20 can easily be replaced. This requires merely loosening the fastening screws 16.1 of all the cutting inserts 20, pushing the cutting inserts 20 apart, and then removing the damaged cutting insert 20. A new cutting insert 20 can be attached, the cutting inserts can be pushed against one another again, and the fastening screws 16 can be tightened. These maintenance jobs can be performed easily and without danger, because the cutting inserts 20 form compact structural units, which are only slight in weight on their own and are easy to handle.

The invention claimed is:

1. A blow bar for a rotary impact crusher, comprising:

a carrier (10) including a recess (18) formed at an edge of the carrier and extending transversely to a tool-advancing direction;

at least two cutting element holders (21) interchangeably fastened within the recess of the carrier (10), wherein in a region of a cutting edge each of the at least two cutting holders (21) includes a milled-out area (21.5) and a seating surface (21.6), wherein the seating surface (21.6) is disposed at an angle to the milled-out area (21.5) and inclined counter to the tool-advancing direction and toward a back side of the cutting element holders (21);

a plurality of wear plates soldered to each of the cutting elements holders (21) within the milled-out area (21.5); and a plurality of cutting elements (23) of a hard material arranged next to one another and soldered to the seating surface (21.6), each abutting a corresponding one or more of the wear plates (22), wherein an impact surface (23.3) on a front side of each of the plurality of cutting elements (23) transitions flush to a front side of the corresponding one or more of the wear plates (22).

2. The blow bar according to claim 1, wherein the recess (18) comprises a supporting surface (18.2) and a bearing surface (18.1) at an angle thereto, with the supporting surface (18.2) facing in the tool-advancing direction (V), the at least two cutting element holders (21) are supported on the supporting surface (18.2) by a contact surface (21.8) facing away from the tool-advancing direction (V), and a bottom adjoining the contact surface (21.8) of each of the at least two cutting element holders (21) rests against the supporting surface (18.1) over a large area.

3. The blow bar according to claim 2, wherein the each of at least two cutting element holders (21) is connected to the carrier (10) by at least one fastening lug (21.9) which is inserted into a fastening socket.

4. The blow bar according to claim 3, wherein the fastening lug (21.9) has a threaded opening (24) that is flush with a screw opening (16.1) that feeds into the fastening socket.

5. The blow bar according to claim 4, wherein the at least two cutting element holders (21) are adjustable relative to one another.

6. The blow bar according to claim 5, wherein the fastening lug (21.9) is inserted into the fastening socket, and when the threaded connection is released a corresponding one of the cutting element holders (21) is adjustable to a limited degree in a longitudinal direction (L) of the cutting edges.

7. The blow bar according to claim 6, wherein the carrier (10) has screw openings (16) facing away from the tool-advancing direction (V), and fastening screws (16.1) inserted through the screw openings (16) and screwed into the cutting element holder (21).

8. The blow bar according to claim 7, wherein each of the fastening screws (16.1) is screwed into a threaded blind hole in a corresponding one of the cutting element holders (21).

9. The blow bar according to claim 8, wherein at a radially outer end facing away from the tool-advancing direction (V), each of the cutting element holders (21) has a chip-diverting surface (21.7) that transitions in a flush manner into a diverting surface (19) of the carrier (10).

10. The blow bar according to claim 9, wherein transversely to the tool-advancing direction (V) each of the cutting element holders (21) is adjoined by a front surface (12) of a base part (11) of the carrier (10).

11. The blow bar according to claim 10, wherein the fastening lug (21.9) has a fastening socket with a threaded opening (24).

12. The blow bar according to claim 3, wherein the fastening lug (21.9) is inserted into the fastening socket, and when the threaded connection is released a corresponding one of the cutting element holder (21) is adjustable to a limited degree in a longitudinal direction (L) of the cutting edges.

13. The blow bar according to claim 2, wherein each of the cutting element holders (21) has a bottom (21.1) that adjoins the contact surface (21.8) at right angles.

14. The blow bar according to claim 1, wherein two wear plates (22) per cutting element (23) are installed and the cutting elements (23) have double a width of the wear plates (22) in the longitudinal direction (L) of the cutting insert.

15. The blow bar according to claim 14, wherein each of the cutting elements (23) are triangular in cross-section with the impact surface (23.3) facing the tool-advancing direction (V) and at an angle thereto has a free surface (23.1) facing away from the tool-advancing direction (V) and the free surface (23.1) and an advancing normal (N) oriented in the tool-advancing direction (V) enclose a free angle ($\alpha$) so that the free surface (23.1) slopes downward from the cutting edge in the direction opposite the tool-advancing direction (V).

16. The blow bar according to claim 1, wherein the cutting element holder (21) is connected to the carrier (10) by at least one fastening lug (21.9) which is inserted into a fastening socket.

17. The blow bar according to claim 16, wherein the fastening lug (21.9) has a fastening socket with a threaded opening (24).

18. The blow bar according to claim 17, wherein the fastening lug (21.9) has a square or a rectangular geometry in cross-section.

19. The blow bar according to claim 18, wherein a central longitudinal axis (M) of the threaded opening (24) extends vertically relative to the contact surface (21.8).

20. The blow bar according to claim 16, wherein the fastening lug (21.9) has a square or a rectangular geometry in cross-section.

21. The blow bar according to claim 16, wherein a central longitudinal axis (M) of the threaded opening (24) extends vertically relative to the contact surface (21.8).

22. The blow bar according to claim 1, wherein the cutting element holders (21) on the carrier (10) are adjustable relative to one another.

23. The blow bar according to claim 1, wherein the carrier (10) has screw openings (16) facing away from the tool-advancing direction (V), and fastening screws (16.1) are inserted through the screw openings (16) are screwed into the cutting element holder (21).

24. The blow bar according to claim 1, wherein at a radially outer end facing away from the tool-advancing direction (V), each of the cutting element holders (21) has a chip-diverting surface (21.7) that transitions in a flush manner into a diverting surface (19) of the carrier (10).

25. The blow bar according to claim 1, wherein transversely to the tool-advancing direction (V) each of the cutting element holders (21) is adjoined by a front surface (12) of a base part (11) of the carrier (10).

26. The blow bar according to claim 1, wherein each of the cutting elements (23) are triangular in cross-section and has an impact surface (23.3) facing in the tool-advancing direction (V) and at an angle thereto has a free surface (23.1) facing away from the tool-advancing direction (V) and the free surface (23.1) and an advancing normal (N) oriented in the tool-advancing direction (V) enclose a free angle ($\alpha$) so that the free surface (23.1) slopes downward from the cutting edge in the direction opposite the tool-advancing direction (V).

* * * * *